US008307876B2

(12) United States Patent
Hughes et al.

(10) Patent No.: US 8,307,876 B2
(45) **Date of Patent: *Nov. 13, 2012**

(54) GARAGE DOOR/TRACK/COUPLER SYSTEM

(76) Inventors: Brian G. Hughes, Indian Lake Estates, FL (US); Brian E. Jones, Hoschton, GA (US)

( * ) Notice: Subject to any disclaimer, the term of this patent is extended or adjusted under 35 U.S.C. 154(b) by 225 days.

This patent is subject to a terminal disclaimer.

(21) Appl. No.: 12/800,946

(22) Filed: May 26, 2010

(65) Prior Publication Data

US 2011/0289849 A1 Dec. 1, 2011

Related U.S. Application Data

(63) Continuation-in-part of application No. 12/800,737, filed on May 21, 2010, which is a continuation-in-part of application No. 12/587,860, filed on Oct. 14, 2009, now Pat. No. 8,151,858.

(51) Int. Cl.
*E06B 3/48* (2006.01)

(52) U.S. Cl. ..... 160/116; 160/201

(58) Field of Classification Search ..... 160/89, 160/90, 116, 180, 201
See application file for complete search history.

(56) References Cited

U.S. PATENT DOCUMENTS

| | | | | | |
|---|---|---|---|---|---|
| 724,472 | A * | 4/1903 | Hegbom | 49/197 |
| 2,916,089 | A * | 12/1959 | D'Orazio | 160/201 |
| 3,938,577 | A * | 2/1976 | Richards | 160/90 |
| 4,637,446 | A * | 1/1987 | McQueen et al. | 160/207 |
| 4,760,872 | A * | 8/1988 | Hale, Jr. | 160/90 |
| 5,050,660 | A * | 9/1991 | Bleichwehl et al. | 160/113 |
| 5,533,561 | A * | 7/1996 | Forehand, IV | 160/188 |
| 5,566,740 | A * | 10/1996 | Mullet et al. | 160/229.1 |
| 5,673,740 | A * | 10/1997 | Park | 160/116 |
| 5,988,256 | A * | 11/1999 | Winters | 160/310 |
| 6,006,814 | A * | 12/1999 | Dalpe | 160/116 |
| 6,073,674 | A * | 6/2000 | Hormann | 160/201 |
| 6,082,430 | A * | 7/2000 | Mock | 160/201 |
| 6,145,570 | A * | 11/2000 | Mullet et al. | 160/191 |
| 6,250,360 | B1 * | 6/2001 | Ochoa | 160/201 |
| 6,289,963 | B1 * | 9/2001 | Vaske | 160/89 |
| D455,840 | S * | 4/2002 | Richardson | D25/48.8 |
| 6,442,897 | B1 * | 9/2002 | Mullet | 49/199 |
| 6,561,256 | B2 * | 5/2003 | Mullet | 160/191 |
| 6,705,378 | B1 * | 3/2004 | Smidt | 160/120 |
| 6,883,579 | B2 * | 4/2005 | Olmsted | 160/189 |
| 7,086,442 | B1 * | 8/2006 | Esparza | 160/113 |
| 7,201,206 | B2 * | 4/2007 | Griebel | 160/116 |
| 7,490,654 | B2 * | 2/2009 | Gomaa et al. | 160/116 |
| 7,784,520 | B2 * | 8/2010 | Paulson | 160/201 |
| 7,857,031 | B2 * | 12/2010 | Mihalcheon et al. | 160/201 |
| 8,091,607 | B2 * | 1/2012 | Aquilina | 160/201 |
| 8,151,858 | B2 * | 4/2012 | Hughes et al. | 160/113 |

(Continued)

*Primary Examiner* — Katherine W Mitchell
*Assistant Examiner* — Johnnie A Shablack

(57) ABSTRACT

A rectangular one-piece garage door has rigid horizontal upper and lower rails and rigid vertical first and second side rails. A small door is mounted in the garage door. A track assembly has horizontal first and second upper tracks. The track assembly has vertical first and second lower tracks. An arcuate first intermediate track couples the first upper track and the first lower track. An arcuate second intermediate track couples the second upper track and the second lower track. First and second upper hinged brackets are secured to the garage door adjacent to the upper rail. First and second lower brackets are secured to the garage door adjacent to the lower rail. Rollers are each coupled to one of the brackets and rotatably received within one of the tracks for guiding the movement of the garage door between a closed lower orientation and an open raised orientation.

15 Claims, 15 Drawing Sheets

U.S. PATENT DOCUMENTS

2001/0035268 A1* 11/2001 Desrochers ..... 160/31
2003/0141023 A1* 7/2003 Griebel ..... 160/180
2004/0144499 A1* 7/2004 Pannell ..... 160/113
2005/0205220 A1* 9/2005 Johnston et al. ..... 160/201
2006/0137832 A1* 6/2006 Alexander ..... 160/113
2006/0201638 A1* 9/2006 Hesketh ..... 160/180
2007/0256798 A1* 11/2007 Aquilina ..... 160/201
2008/0115416 A1* 5/2008 Clark ..... 49/142
2008/0202698 A1* 8/2008 Dalton et al. ..... 160/89
2008/0295979 A1* 12/2008 Carlsen ..... 160/197

* cited by examiner

FIG 1
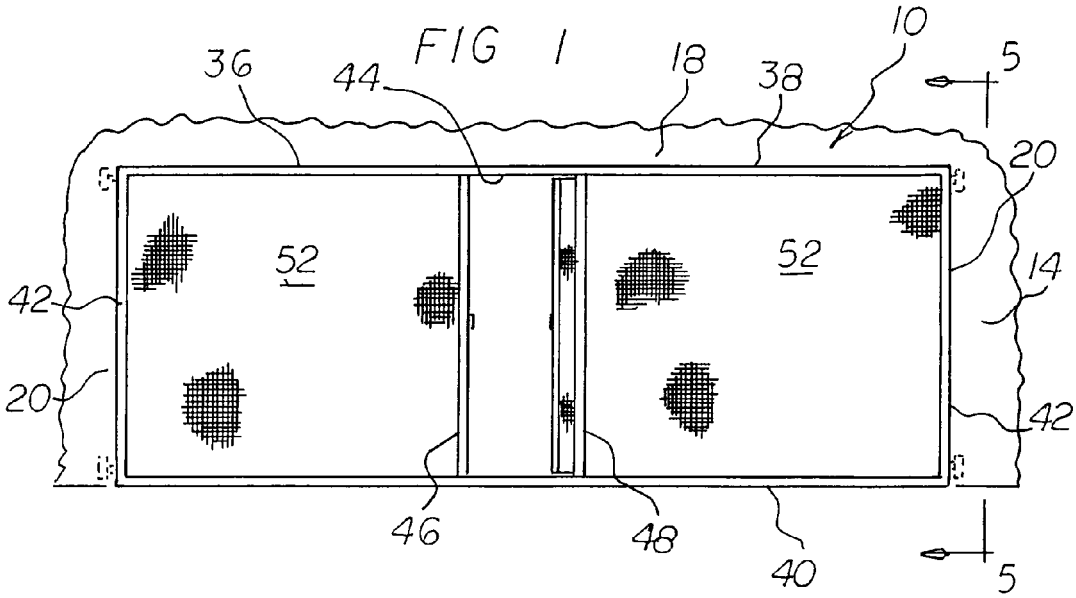
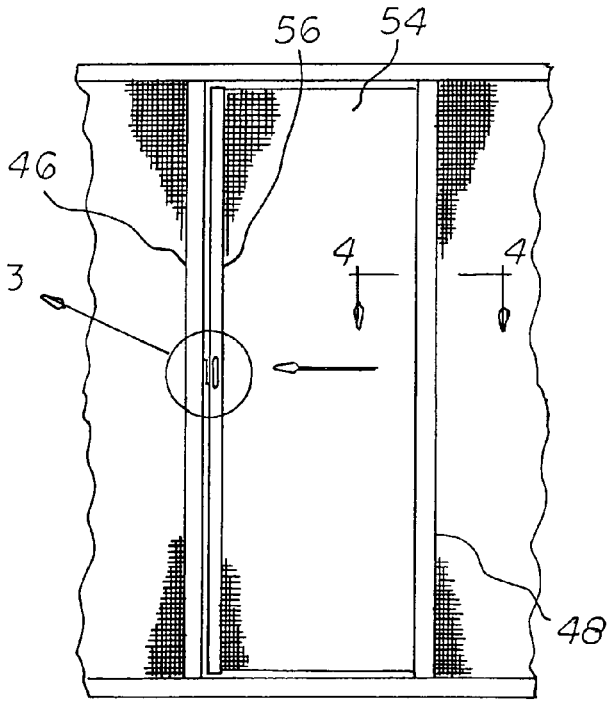
FIG 2
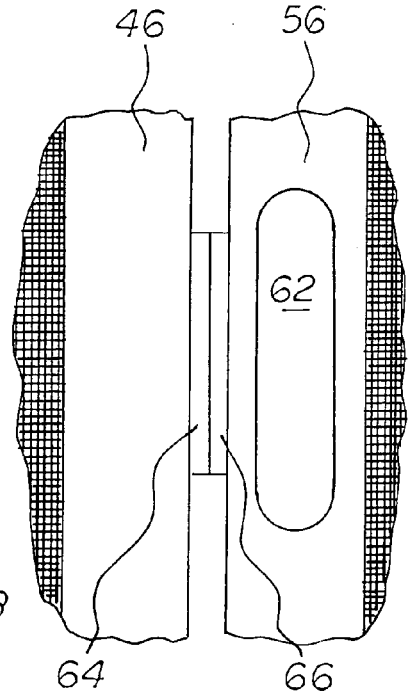
FIG 3

FIG 4
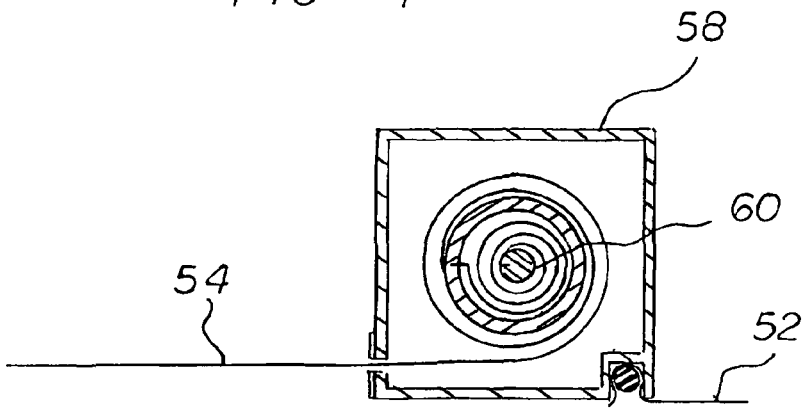
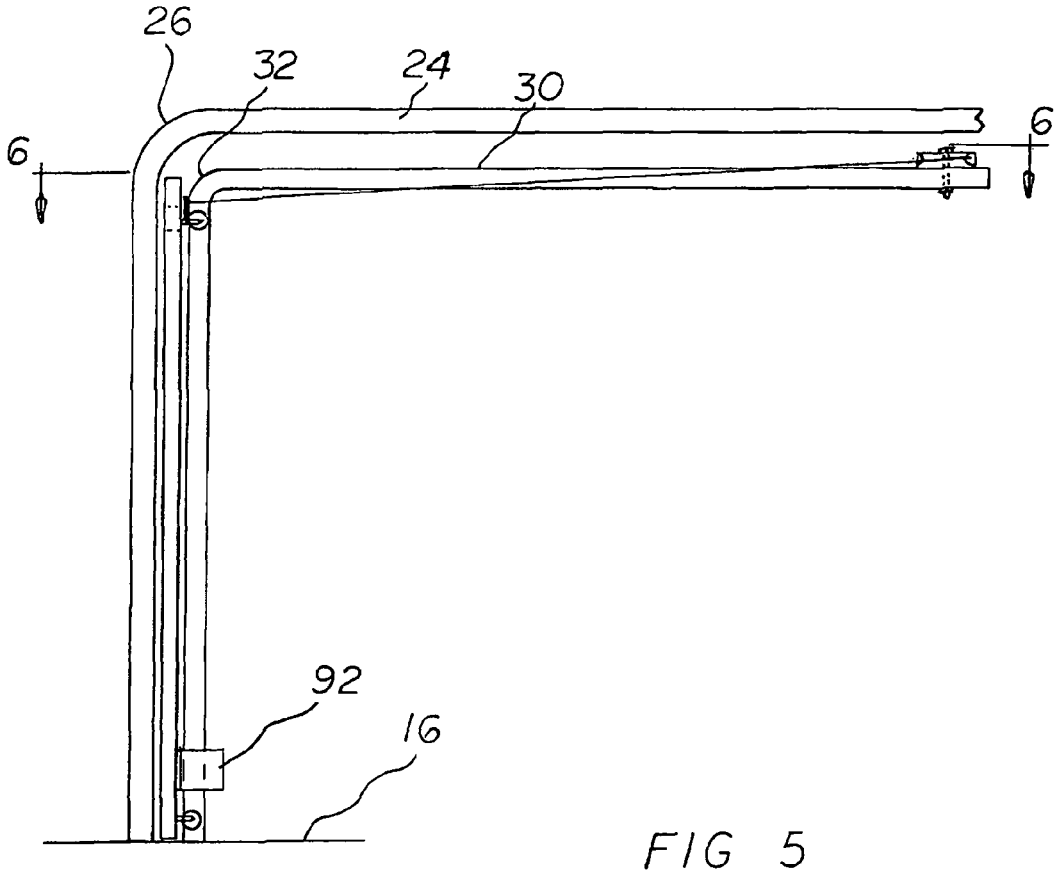
FIG 5

FIG 6
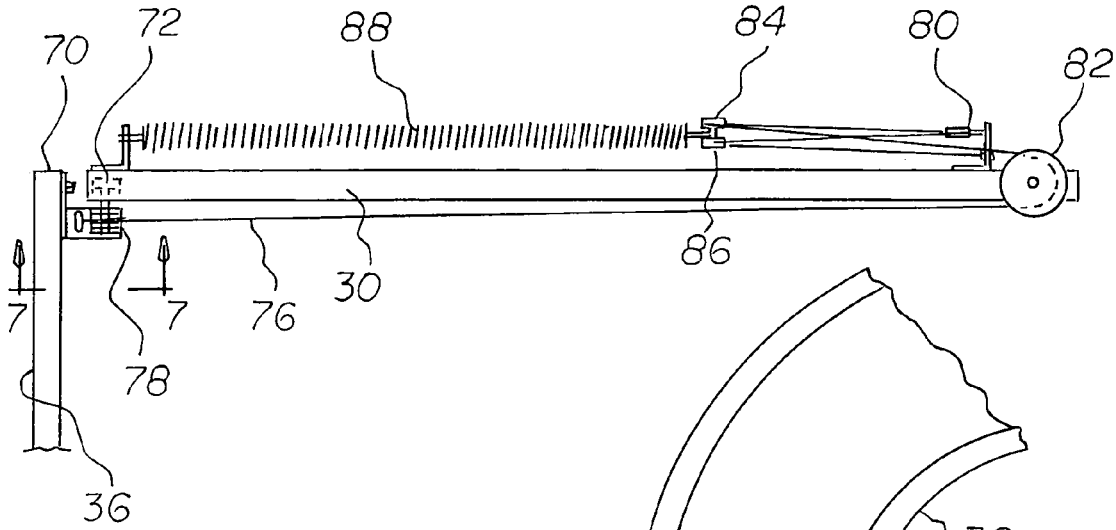
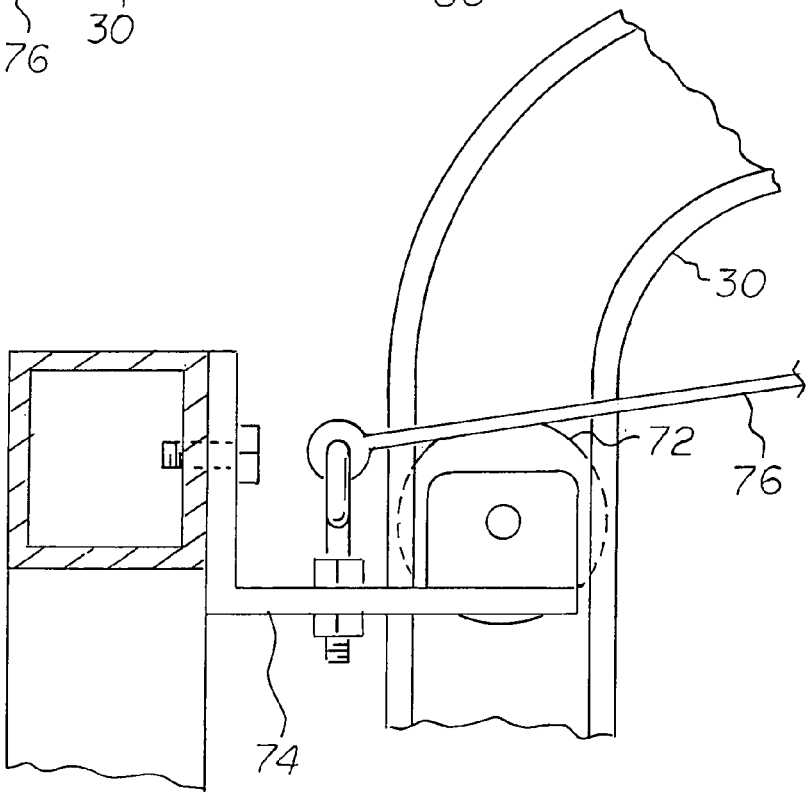
FIG 7

FIG 8
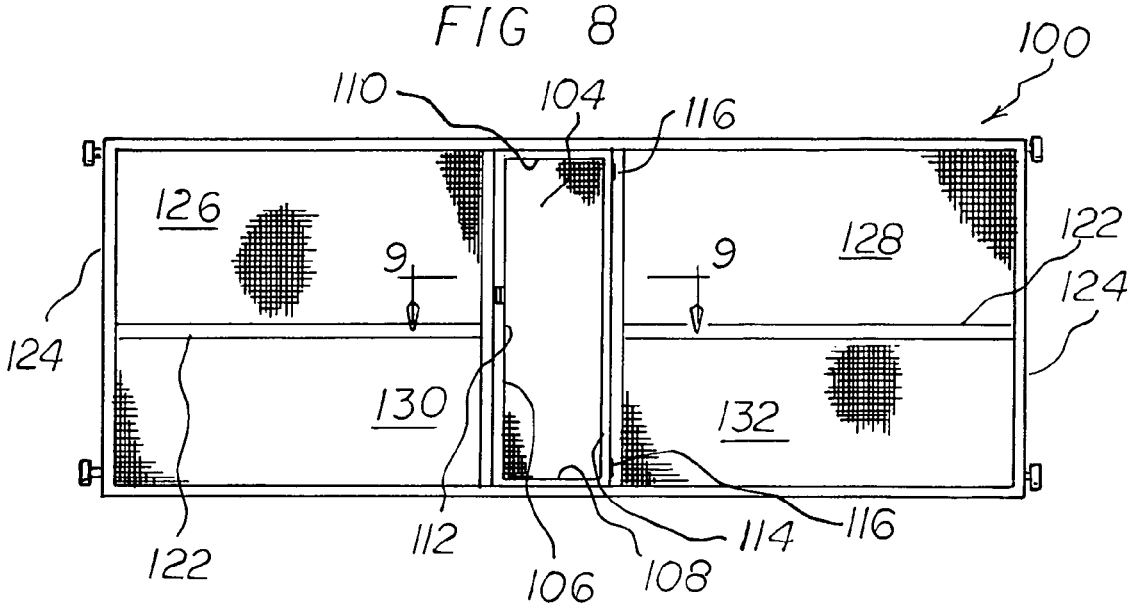
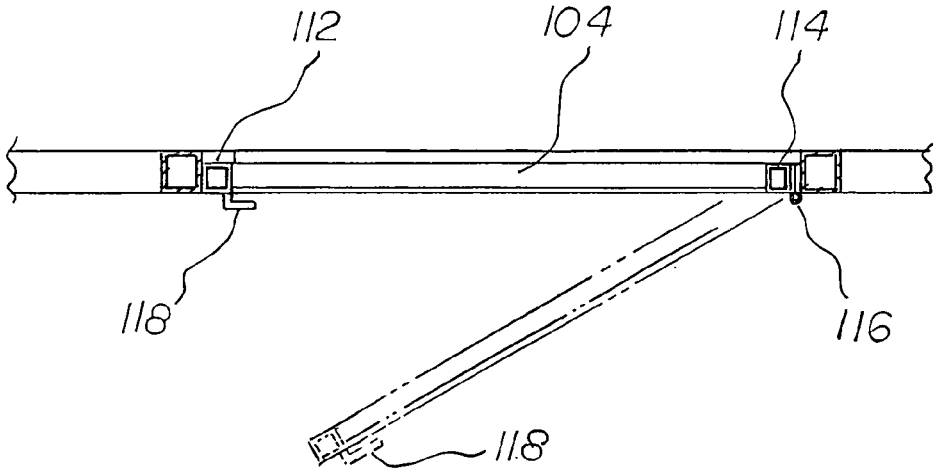
FIG 9

FIG 17
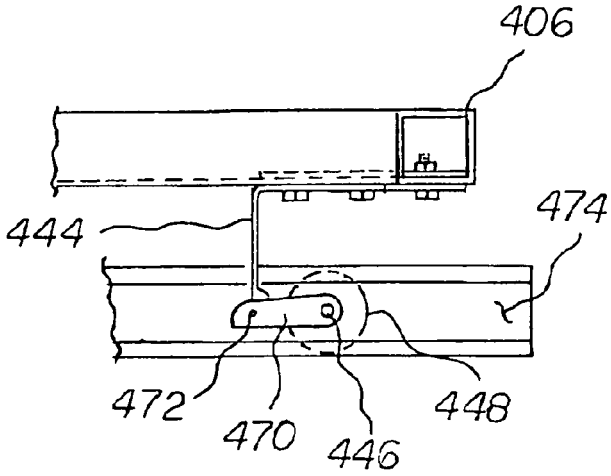
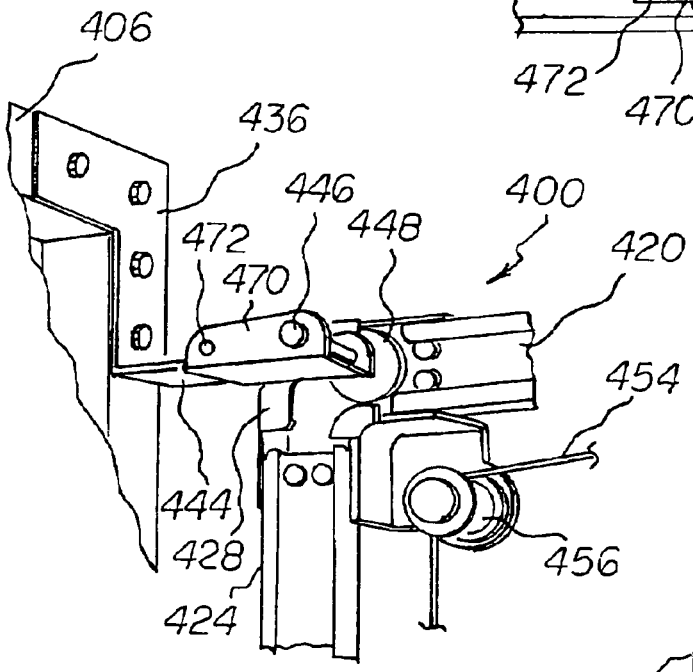
FIG 18
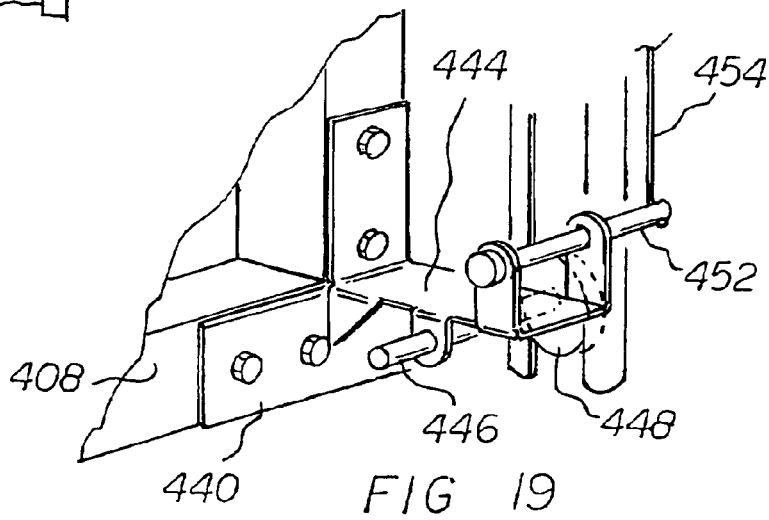
FIG 19

FIG. 20
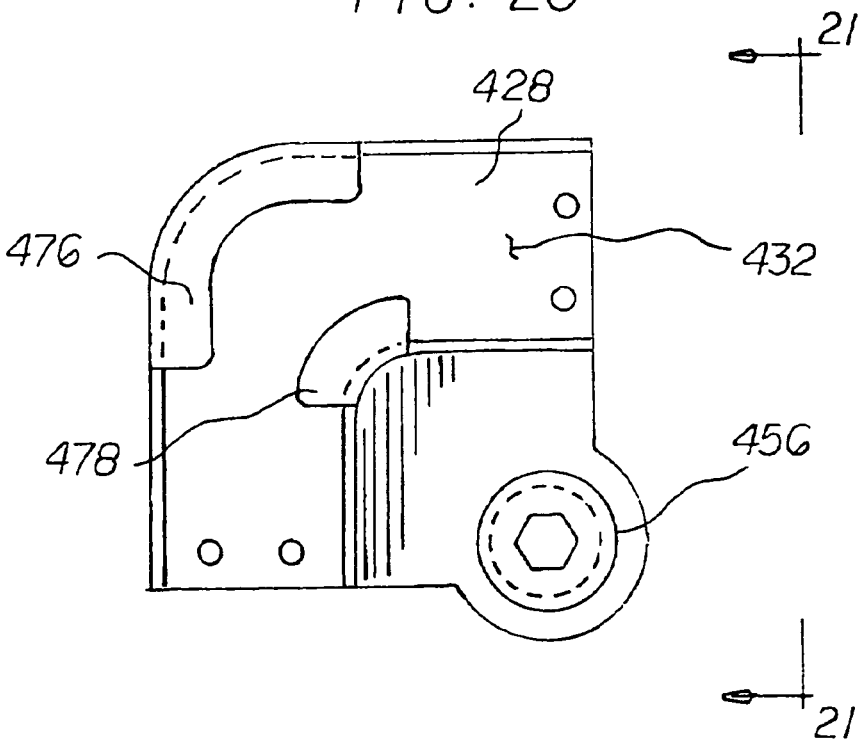
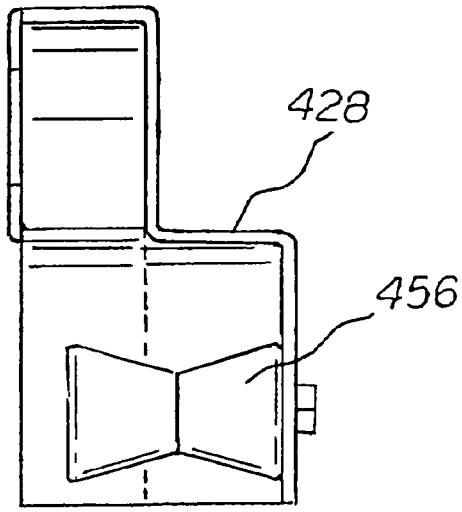
FIG. 21

FIG 22
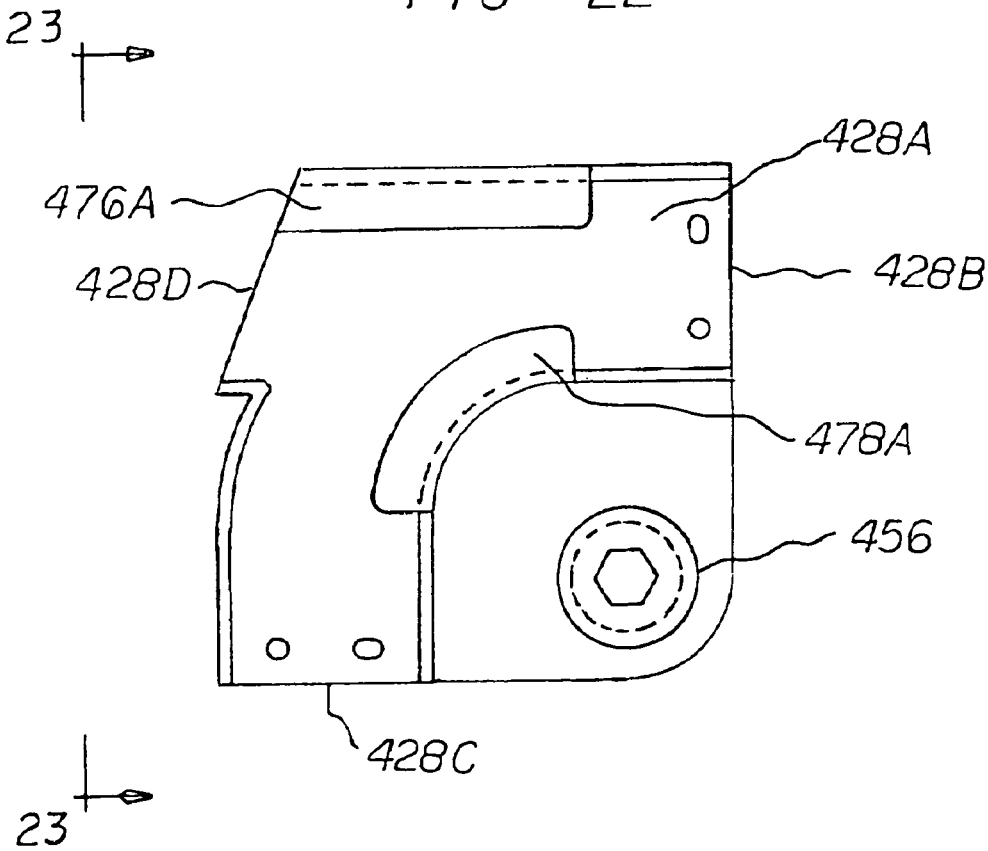
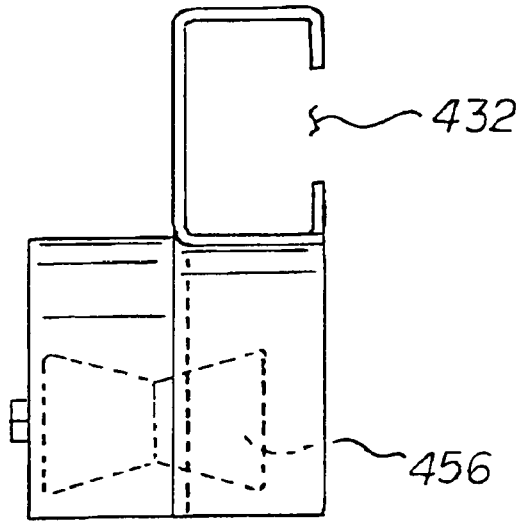
FIG 23

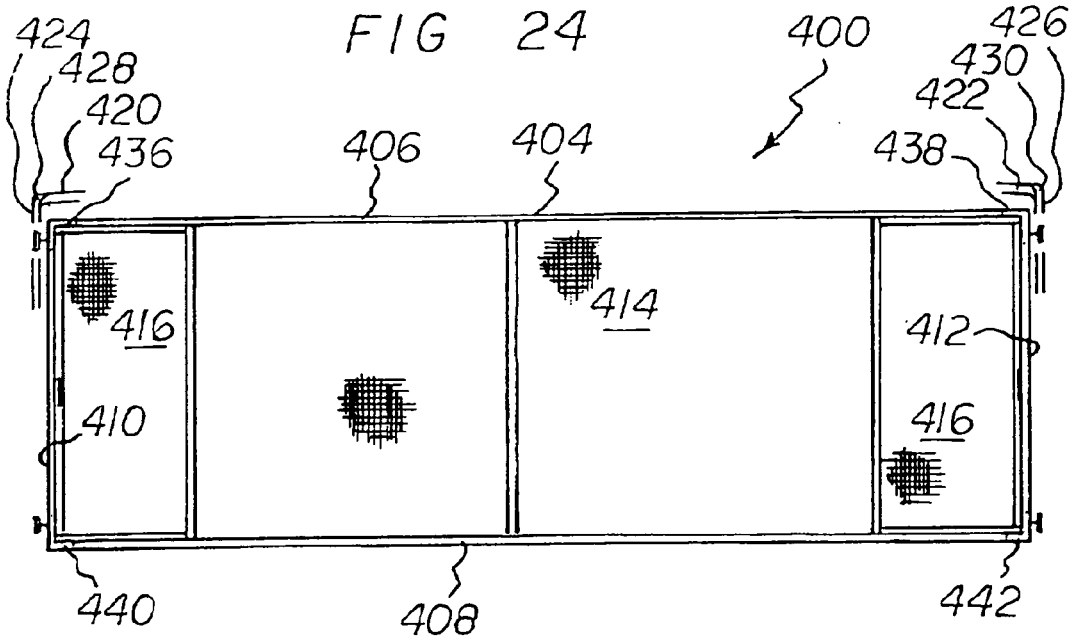
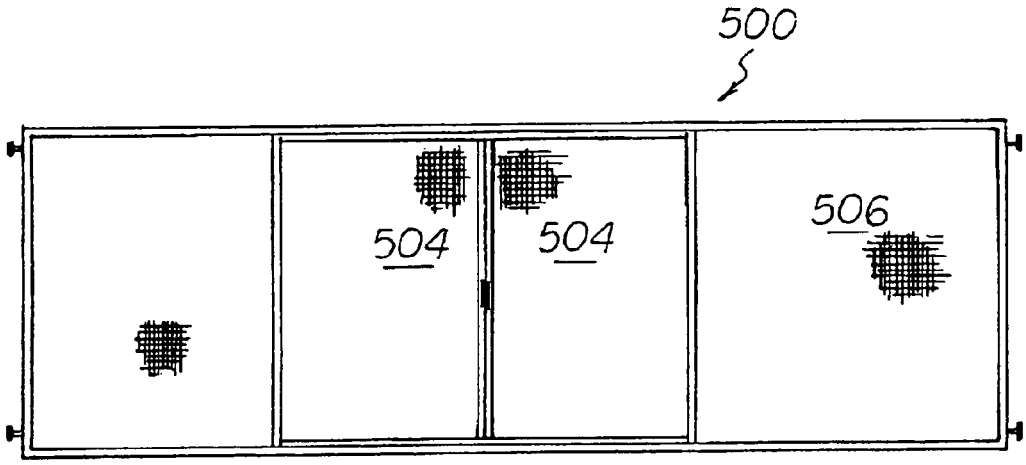
FIG 25

FIG 26
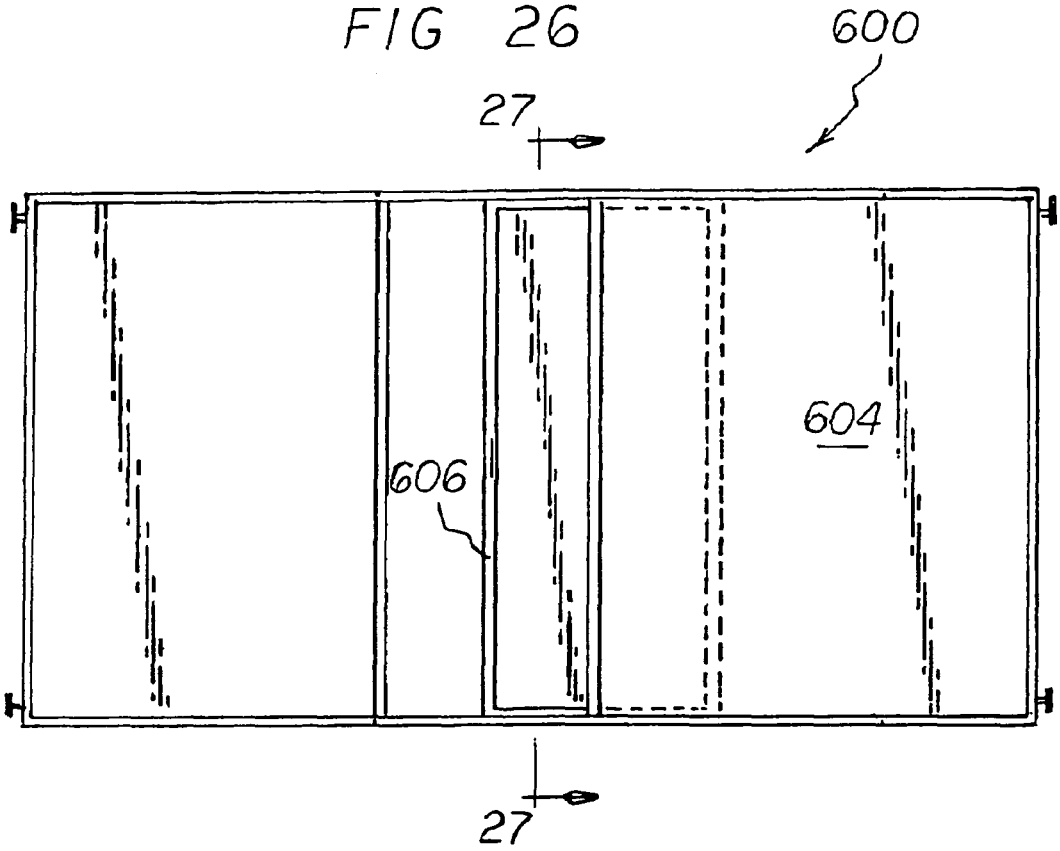
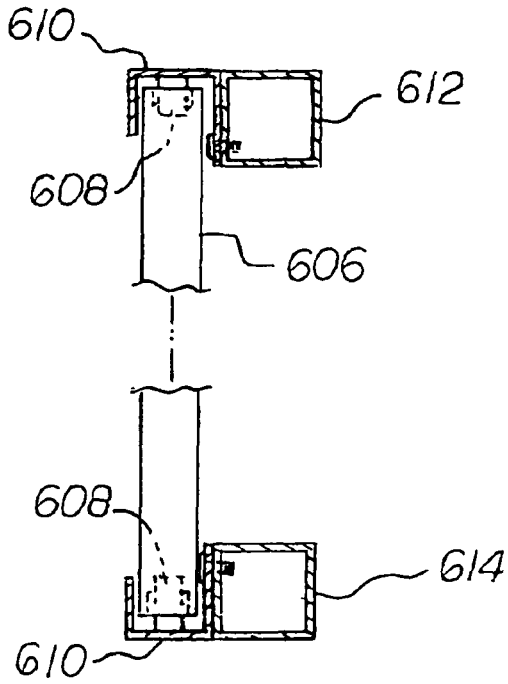
FIG 27

FIG 28
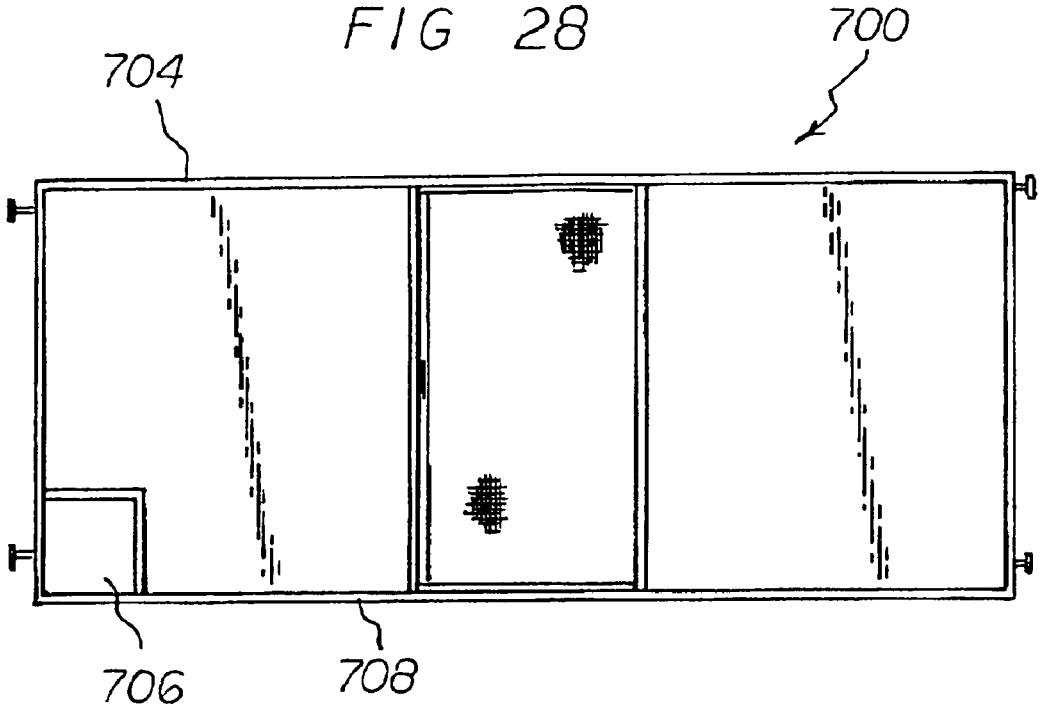
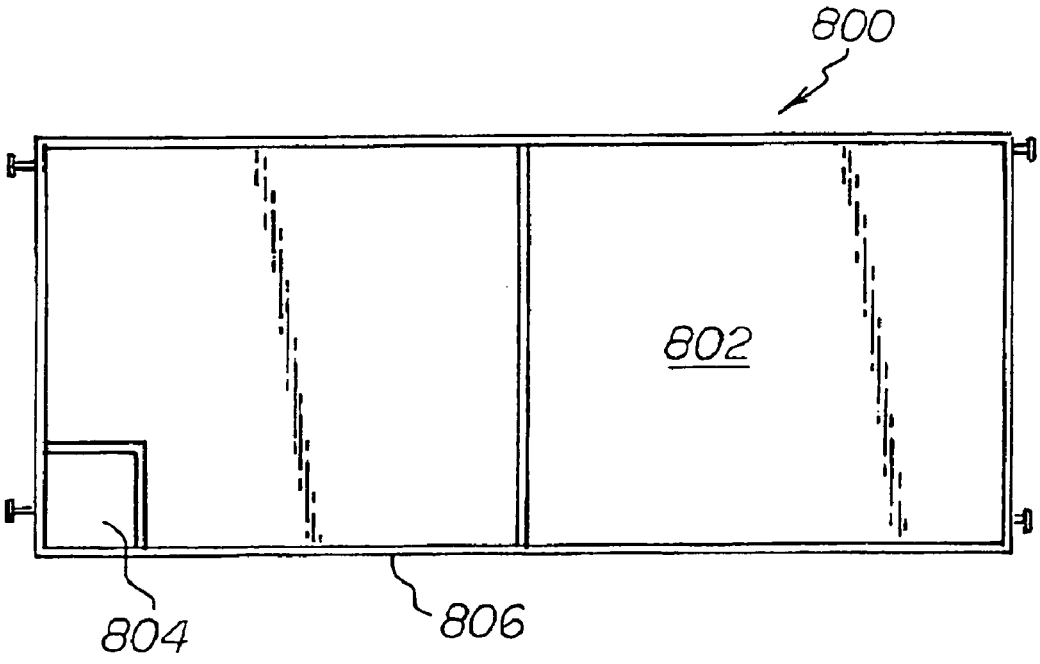
FIG 29

GARAGE DOOR/TRACK/COUPLER SYSTEM

RELATED APPLICATIONS

The present patent application is a continuation-in-part of pending U.S. Patent Application filed May 21, 2010, with the serial number of which is not yet available, which is, in turn, a continuation in part of U.S. patent application Ser. No. 12/587,860 filed Oct. 14, 2009, the subject matter of which applications is incorporated herein by reference.

BACKGROUND OF THE INVENTION

Field of the Invention

The present invention relates to a garage door/track/coupler system and, more particularly, pertains to new and novel coupling assemblies and new and novel track assemblies used to slidably couple a secondary one-piece garage door that is used as a screened closure for the garage to the secondary tracks on which the secondary garage door moves. The objectives of the present invention are achieved in a safe, convenient and economical manner.

SUMMARY OF THE INVENTION

In view of the foregoing disadvantages inherent in the known types of garage door systems now present in the prior art, the present invention provides an improved garage door/track/coupler system. As such, the general purpose of the present invention, which will be described subsequently in greater detail, is to provide a new and improved garage door/track/coupler system and method which has all the advantages of the prior art and none of the disadvantages.

The garage door/track/coupler system of the present invention is for slidably coupling a one-piece garage door to inverted L-shaped guide tracks through wheeled coupling assemblies. The coupling is done in a convenient and economical manner.

First provided in the preferred embodiment is a one-piece garage door. The garage door has a rectangular configuration with a horizontal upper rail and a parallel lower rail separated by a height. The garage door has a vertical first side rail and a parallel second side rail separated by a width. Each of the rails is rigid. The garage door has a screen secured to, and extending between, the upper and lower and side rails. The garage door has a front face and a rear face. A small screen door is mounted in the garage door. The screen door constitutes between 12.5 and 25 percent of the area of the garage door. The screen door is movable with respect to the garage door between an open orientation and a closed orientation.

Next provided is a track assembly. The track assembly has a horizontal first upper track and a parallel second upper track. The first and second upper tracks are separated by a width greater than the width of the garage door. The track assembly has a vertical first lower track and a parallel second lower track. The first and second lower tracks are separated by a width greater than the width of the garage door. Each of the upper and lower tracks has a C-shaped cross-sectional configuration with a maximum height of 2 inches plus or minus 10 percent. Each track has an interiorly facing opening of between 0.25 and 0.75 inches. Newly designed and manufactured arcuate intermediate tracks couple one upper track with one lower track into an inverted L-shaped configuration. A first intermediate track couples the first upper track to the first lower track forming the first track assembly. A second intermediate track couples the second upper track to the second lower track forming the second track assembly. Each intermediate track has a radius of curvature between 1 and 2 inches. The intermediate tracks have an interiorly facing opening and guides to maintain a continuous interior channel from the horizontal upper track to the vertical lower tracks. The tight radius of curvature is necessary to allow the secondary garage door to operate within the available clearances of the garage chamber. The first and second track assemblies allow the one-piece garage door to slide from horizontal open position to vertical closed position within this tight curvature.

Next provided are newly designed and manufactured upper hinged brackets. The first upper hinged bracket is secured to the rear face of the garage door adjacent to an intersection of the upper rail and the first side rail. The second upper hinged bracket is secured to the rear face of the garage door adjacent to an intersection of the upper rail and the second side rail. A perpendicular arm extends interiorly from each upper hinged bracket. A hinge pin is secured to each arm parallel with the upper and lower rails of the garage door and connects the perpendicular arm to a hinged wheel assembly. The hinged wheel assembly is made up of a flat-bottomed U-shaped arm extending from the hinge pin to an axle. The axle extends through the opening of the upper track. A plurality of rollers is provided next. One roller is secured to each axle and rotatably received within the upper tracks. The upper hinged brackets are necessary to allow the secondary garage door to operate within the available clearances of the garage chamber, to keep its rollers in the upper tracks at all times and to allow the garage door to be in the desired position when open and closed.

Next provided are newly designed and manufactured lower brackets. The first lower bracket is secured to the rear face of the garage door adjacent to an intersection of the lower rail and the first side rail. The second lower bracket is secured to the rear face of the garage door adjacent to an intersection of the lower rail and the second side rail. A perpendicular arm extends interiorly from each lower bracket. An axle is secured to each arm parallel with the upper and lower rails of the screen door. The axle extends through the opening of the lower track. One roller is secured to each axle and rotatably received within the lower tracks. The lower brackets are necessary to allow the garage door to be in the desired position when open and closed and to allow its rollers to move from the lower track to the upper track as the garage door moves from the closed to the open position and vice versa.

Lastly, a lifting rod is secured to the first lower bracket. A cable has a first end coupled to the lifting rod and a second end coupled to a spring. The cable has an intermediate extent trained around a pulley. The pulley has an axis of rotation passing through the first intermediate track. A lifting rod is secured to the second lower bracket. A cable has a first end coupled to the lifting rod and a second end coupled to a spring. The cable has an intermediate extent trained around a pulley that has an axis of rotation passing through the second intermediate track. The lifting mechanism thereby formed reduces the amount of effort required to lift the garage door from the closed lower orientation to the open raised orientation. The lifting mechanism also allows the garage door to be gently lowered from the open raised orientation to the closed lower orientation.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved garage door/track/coupler system which has all of the advantages of the prior art for garage door/track/coupler systems and none of the disadvantages.

It is another object of the present invention to provide a new and improved garage door/track/coupler system which may be easily and efficiently manufactured and marketed.

It is further object of the present invention to provide a new and improved garage door/track/coupler system which is of durable and reliable constructions.

An even further object of the present invention is to provide a new and improved garage door/track/coupler system which is susceptible of a low cost of manufacture with regard to both materials and labor, and which accordingly is then susceptible of low prices of sale to the consuming public, thereby making such garage door/track/coupler system economically available to the buying public.

Even still another object of the present invention is to provide a garage door/track/coupler system for slidably coupling a one-piece garage door to inverted L-shaped guide tracks through wheeled coupling assemblies, in a safe, convenient, and economical manner.

Lastly, it is an object of the present invention to provide a new and improved rectangular one-piece garage door having rigid horizontal upper and lower rails and rigid vertical first and second side rails. A small door is mounted in the garage door. A track assembly has horizontal first and second upper tracks. The track assembly has vertical first and second lower tracks. An arcuate first intermediate track couples the first upper track and the first lower track. An arcuate second intermediate track couples the second upper track and the second lower track. First and second upper hinged brackets are secured to the garage door adjacent to the upper rail. First and second lower brackets are secured to the garage door adjacent to the lower rail. Rollers are each coupled to one of the brackets and rotatably received within one of the tracks for guiding the movement of the garage door between a closed lower orientation and an open raised orientation. These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated a primary and preferred embodiment of the invention as well as alternate embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a garage screen door system constructed in accordance with the principles of the present invention.

FIG. 2 is an enlarged front elevational view of the central portion of the system shown in FIG. 1 but with the screen door closed.

FIG. 3 is an enlarged front elevational view of the central portion of the system taken at Circle 3 of FIG. 2.

FIG. 4 is a cross sectional view taken at line 4-4 of FIG. 2.

FIG. 5 is an end elevational view of the system taken along line 5-5 of FIG. 1.

FIG. 6 is a plan view of the system taken along line 6-6 of FIG. 5.

FIG. 7 is a cross sectional view taken at line 7-7 of FIG. 6.

FIG. 8 is a front elevational view similar to FIG. 1 but illustrating an alternative embodiment of the invention.

FIG. 9 is a plan view taken at line 9-9 of FIG. 8 but with the door, shown in broken lines, in an open orientation.

FIG. 17 is a side elevational view of the track assembly and coupling assembly of the first track assembly and the first upper hinged bracket coupler constructed in accordance with the principles of the garage door/track/coupler system of the present invention.

FIG. 18 is a perspective view of the track and coupling assemblies shown in FIG. 17.

FIG. 19 is a perspective view of the lower track assembly and lower coupling assembly of the first track assembly and the first lower bracket coupler constructed in accordance with the principles of the garage door/track/coupler system of the present invention.

FIG. 20 is a front elevational view of an arcuate intermediate track shown in FIG. 18.

FIG. 21 is an end elevational view taken along line 21-21 of FIG. 20.

FIG. 22 is a front elevational view of an arcuate intermediate track constructed in accordance with an alternate embodiment of the invention.

FIG. 23 is an end elevational view taken along line 23-23 of FIG. 22.

FIG. 24 is a front elevational view of a one-piece garage door with two widely spaced smaller screen doors representing an alternate embodiment of the garage door of the present invention.

FIG. 25 is a front elevational view of a one-piece garage door with two narrowly spaced smaller screen doors representing an alternate embodiment of the garage door of the present invention.

FIG. 26 is a front elevational view of a one-piece garage door with one centrally located sliding screen door which utilizes rollers to slide from open to closed position and vice versa, representing an alternate embodiment of the garage door of the present invention.

FIG. 27 is a cross sectional view taken along line 27-27 of FIG. 26.

FIG. 28 is a front elevational view of a one-piece garage door with a central smaller screen door and an additional smaller pet door along the lower rail of the garage door representing an alternate embodiment of the garage door of the present invention.

FIG. 29 is a front elevational view of a one-piece garage door without a central smaller screen door but with the smaller pet door along the lower rail of the garage door representing an alternate embodiment of the garage door of the present invention.

The same reference numerals refer to the same parts throughout the various Figures.

DESCRIPTION OF THE PREFERRED EMBODIMENTS

Figure 10:
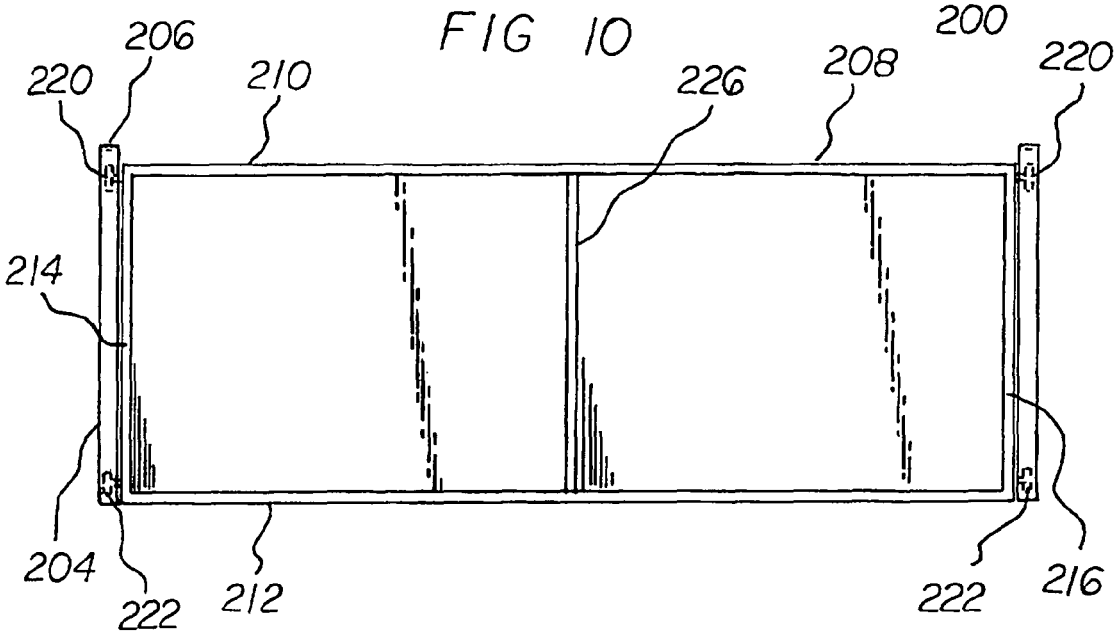
FIG. 10 is front elevational view of a garage door system without a central screen door constructed in accordance with another alternate embodiment of the invention.
Figure 11:
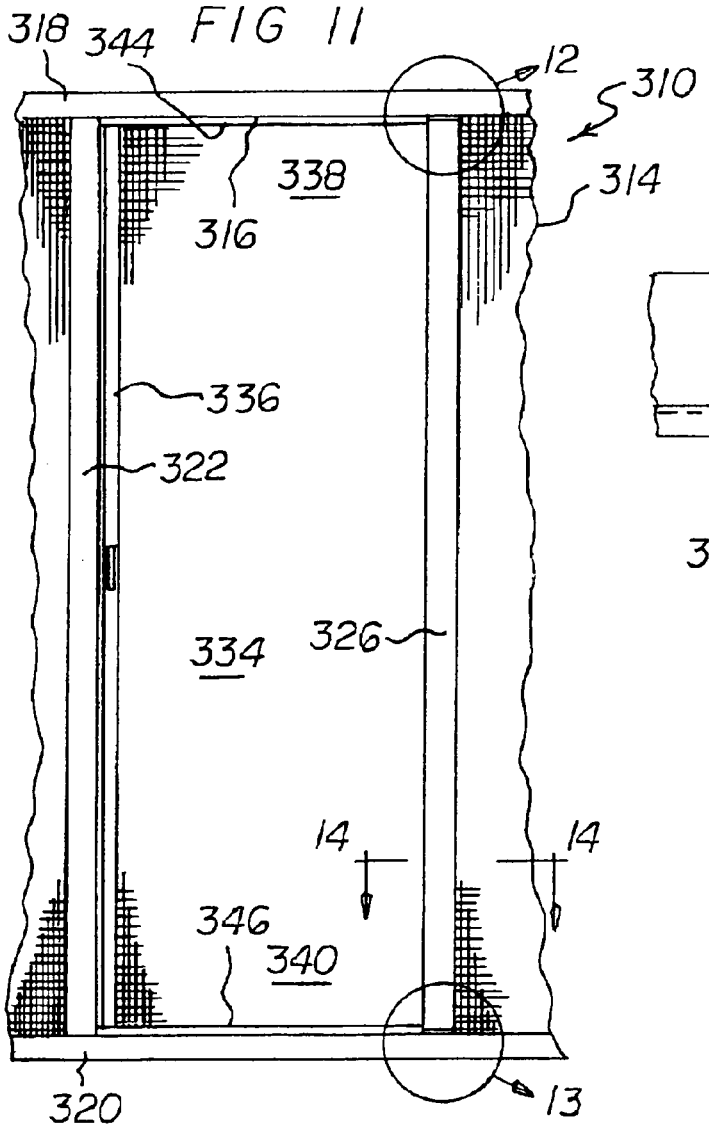
FIG. 11 is a front elevational view of a retractable screen door system constructed in accordance with the principles of the present invention.
Figure 12:
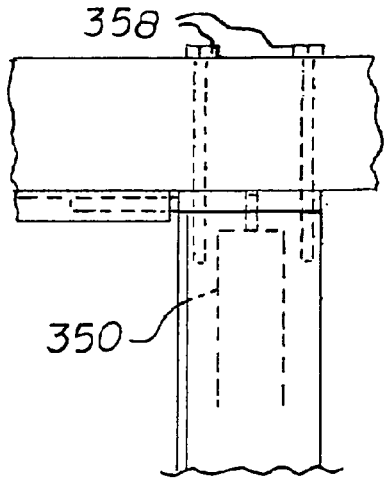
FIG. 12 is an enlarged front elevational view of the system taken at circle 12 of FIG. 11.
Figure 13:
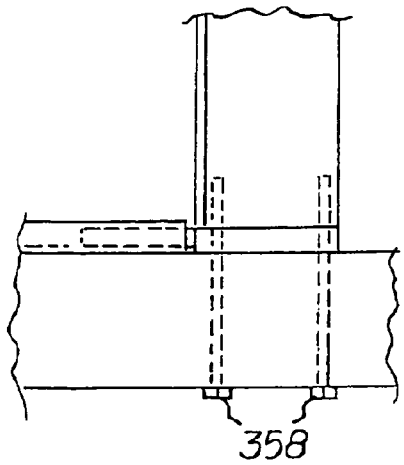
FIG. 13 is an enlarged front elevational view of the system taken at circle 13 of FIG. 11.

With reference now to the drawings, and in particular to FIGS. 1, 11, 17, 18, 19, 18A, 19A and 24 thereof, the preferred embodiments of the new and improved garage door/track/coupler system embodying the principles and concepts of the present invention and generally designated by the reference numerals 10 and 310 and 400 will be described.

The garage screen door system 10 of the present invention is comprised of a plurality of components. Such components in their broadest context include a secondary single panel garage door, a rectangular portal, a screen door, a paired track assembly, a paired hinged upper roller bracket coupling assembly, a paired lower roller bracket coupling assembly and a lifting mechanism. Such components are individually configured and correlated with respect to each other so as to attain the desired objective.

First provided is a garage 14. The garage has a chamber with a front opening. The garage has a horizontal floor 16. The garage has a parallel ceiling 18. The ceiling is spaced for a garage door with a height of between about 6 feet and about 16 feet. The garage has vertical side walls 20. The side walls are spaced for a garage door with a width of between about 8 feet and about 20 feet.

Primary tracks 24 are provided. Each track is in an inverted L-shaped configuration. Each track is mounted to a side wall. Each primary track has a vertical section within the chamber adjacent to the front opening. Each track has a horizontal section extending into the chamber. Each primary track has a curved intermediate section 26. The intermediate section has a radius of curvature of about 15 inches. Each primary track is adapted to receive and support a primary garage door. In this manner movement is allowed between a closed orientation between the vertical sections and an open orientation between the horizontal sections.

Secondary tracks 30 are provided. Each secondary track is in an inverted L-shaped configuration. Each secondary track is mounted with respect to a side wall. Each secondary track has a vertical section adjacent to the front opening. Each secondary track has a horizontal section extending into the chamber and depending from the primary track. Each secondary track has an arcuate intermediate section 32. The intermediate section has a radius of curvature of between 1 and 2 inches. The secondary track with its intermediate section is radially interior of and spaced a common distance from the primary track.

Provided next is a single panel secondary garage door 36. The secondary garage door has upper and lower rails 38,40. The secondary garage door has side rails 42. The rails are mounted for movement in the secondary tracks between a closed orientation between the vertical sections and an open orientation between the horizontal sections.

A rectangular portal 44 is provided next. The rectangular portal is centrally positioned within the secondary garage door. First and second vertical door rails 46, 48 are provided. In this manner the lateral extent of the portal and central extents of the upper and lower rails define the elevational extent of the portal.

Major screens 52 are provided. The major screens are secured laterally between one of the side rails and an adjacent vertical door rail. Each major screen is secured elevationally between the upper and lower rails at locations remote from the portal.

Further provided is a screen door 54. The screen door is formed of a flexible screen. The screen door has a height essentially equal to the height of the portal. The screen door has a width greater than the width of the portal. The flexible screen has an exterior end. The exterior end has a vertical support 56. The screen door has an interior end. A vertical housing 58 is provided. The vertical housing is coupled with the second vertical door rail. The housing has a spring loaded spool 60. The spool receives the flexible screen. In this manner movement of the flexible screen between a closed orientation covering the portal and an open orientation within the housing is allowed. The vertical support has a handle 62. The vertical support encompasses the spool. In this manner the opening and closing the screen door is facilitated. The first vertical door rail and the vertical support have magnets 64, 66. In this manner the flexible screen is maintained in a closed orientation.

Provided next is a lifting assembly 70 for the secondary garage door. The lifting assembly includes a 2 inch roller 72. The 2 inch roller extends outwardly with respect to each end of the upper and lower rails. The rollers are received for movement within the secondary tracks. The lifting assembly includes a first bracket 74. The first bracket couples the upper rail and one of the rollers. The lifting assembly includes a cable 76. The cable has a first end 78. The first end is coupled to the first bracket. The cable has a second end 80. The second end is laterally secured with respect to the horizontal section of the secondary track remote from the front opening. The lifting assembly includes a major pulley 82. The lifting assembly includes secondary pulleys 84, 86. The pulleys guide the movement of the screen door when lifting and lowering. The lifting assembly also includes a coil spring 88. The coil spring couples the secondary pulleys with respect to the horizontal section of the secondary track adjacent to the front opening. In this manner the strength needed to lift and lower the secondary garage door is minimized.

Lastly provided is a beam deflector 92 secured to the secondary garage door adjacent to one side of the lower rail. The beam deflector is adapted to disrupt an electric eye light beam normally extending close to the floor from one side wall of the opening to the other side wall of the opening. This is for functioning as a safety measure to preclude interference between the primary garage door and secondary garage door while moving between the open and closed orientations.

Reference in now made to the alternate embodiment 100 of the invention as illustrated in FIGS. 8 and 9. A screen door 104 is provided. The screen door is in a rectangular configuration. The screen door includes a frame 106. The frame has a horizontal lower rail 108. The frame has a parallel upper rail 110. The upper and lower rails are spaced by a height essentially equal to the height of the portal. The frame has vertical side rails 112, 114. The side rails couple the upper and lower rails. The side rails are spaced by a width essentially equal to the width of the portal. The frame further includes hinges 116. The hinges pivotally couple the screen door to the garage door. The screen door has a handle 118. In this manner opening and closing of the screen door is facilitated.

A chair rail 122 is provided. An end rail 124 is provided. The chair rail is horizontally supported on the garage door between the end rail and an adjacent vertical side rail of the frame. The major screening is in four sections. Two sections 126, 128 are located on each vertical side rail of the frame above the chair rail. Two sections 130, 132 are located on each vertical side rail of the frame below the chair rail.

FIG. 10 illustrates another embodiment of the invention. In such embodiment, a garage door system 200 is provided.

Such garage door system comprises two laterally spaced tracks. Each track is formed in an inverted L-shaped configuration with a vertical section 204 and a horizontal section 206.

A single panel garage door 208 is next provided. Such garage door has a rigid peripheral frame formed with a horizontal upper rigid rail 210 and a parallel lower rigid rail 212 and laterally spaced side rigid rails 214, 216 between the upper and lower rigid rails. The garage door is adapted to be fabricated of any suitable material with or without windows.

A pair of upper rollers 220 extend outwardly from adjacent to the upper rigid rail. A pair of lower rollers 222 extend outwardly from adjacent to the lower rigid rail. The two pair of rollers are slidably received in the tracks.

Lastly, a divider rail 226 extends between the upper and lower rigid rails parallel with the side rigid rails. The divider rail is adapted to be used in the installation of a service door which may later be formed in the garage door. Like the garage door, the service door is adapted to be fabricated of any suitable material.

Reference is now made to FIGS. 11 through 16 which illustrates the retractable screen door system 310 of the present invention. The retractable screen door system is for rotationally extending a screen door for use and for rotationally retracting the screen door for storage. The extending and retracting is done in a safe, reliable, convenient and economical manner.

First provided in the preferred embodiment of the retractable screen door system is a one-piece garage door 314 having an opening 316 there through. The opening is fixedly bounded by a horizontal upper rail 318 and a horizontal lower rail 320, a vertical fixed post 322 and a hollow vertical housing post 326. The hollow vertical housing post is formed with a vertical open slot 330.

Next, a flexible screen door 334 is provided. The flexible screen door has a free vertical edge with a rigid vertical support 336. The screen door has horizontal upper and lower edges 338, 340. The screen door has a vertical constrained edge 342.

An upper track 344 attached to the upper rail and a lower track 346 attached to the lower rail are next provided. The tracks are adapted to slidably support the upper and lower edges of the screen door for reciprocal movement.

Next provided is a cylindrically shaped spring cartridge 350. The spring cartridge is located in the housing post with upper and lower ends mounted for rotational movement about a vertical axis. The spring cartridge has an exterior surface receiving and supporting the constrained edge of the screen door. In this manner, rotation of the cartridge in a first direction will allow the screen door to cover the opening 316 while rotation of the cartridge in an opposite second direction will allow the door to uncover the opening.

Next, an upper end cap 354 between the upper end of the cartridge and the upper rail is provided. Also a lower end cap 356 is provided between the lower end of the cartridge and the lower rail. A plurality of self-tapping screws 358 couple the end caps to the rails and to the cartridge. The upper end of the cartridge is formed with an upstanding tab 360. The upper end cap is formed with a slot 362 receiving the upstanding tab for controlling the rotation of the cartridge and reciprocation of the door. Each end cap has a lateral projection 364 receiving and supporting the upper and lower tracks. Vertically extending short posts 366 are formed in each end cap and received in the upper and lower ends of the hollow housing post to provide rigidity.

Lastly, horizontal spline grooves 370, 372 are formed in the upper and lower rails. Vertical spline grooves 374, 376, 378 are formed in alignment in the upper end cap and the housing post and the lower end cap. The spline grooves are adapted to receive and support screens and splines while allowing for efficient screen replacement.

Figure 14:
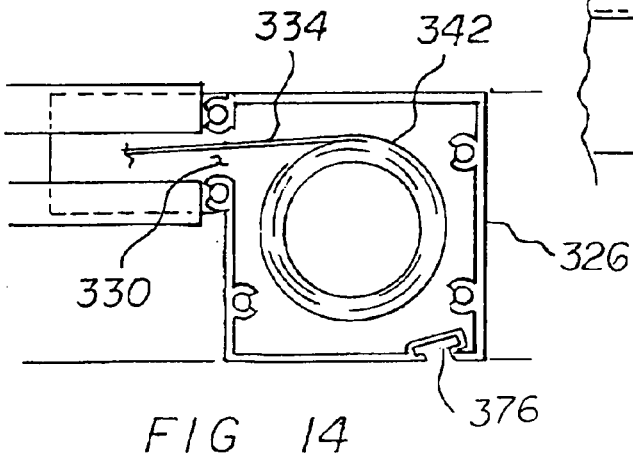
FIG. 14 is a cross sectional view of the system taken along line 14-14 of FIG. 11.
Figure 14A:
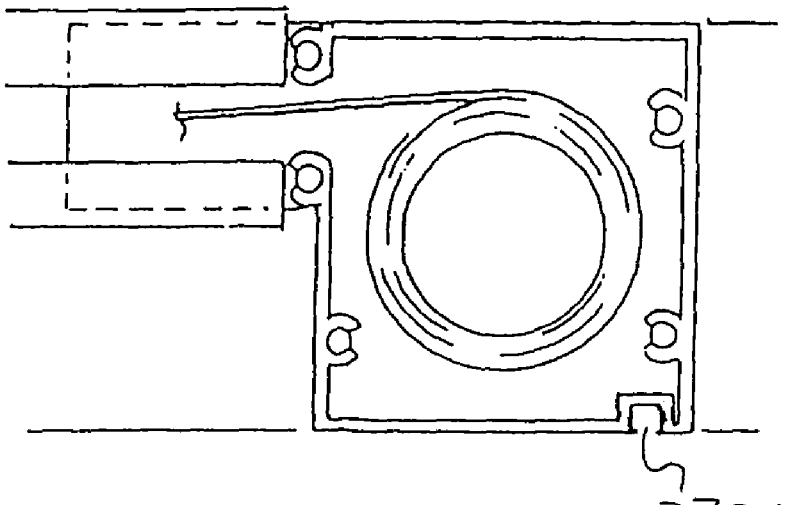
FIGS. 14A and 14B are cross sectional views showing spline grooves shaped in accordance with alternate embodiments of the invention.
Figure 14B:
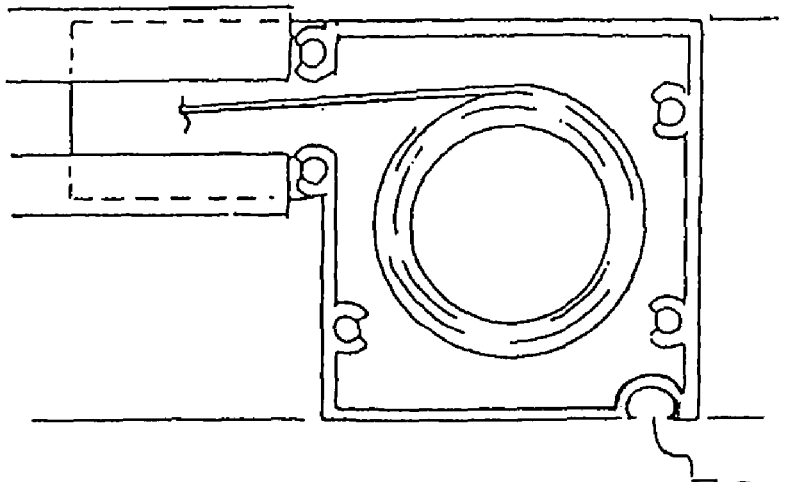
Figure 15:
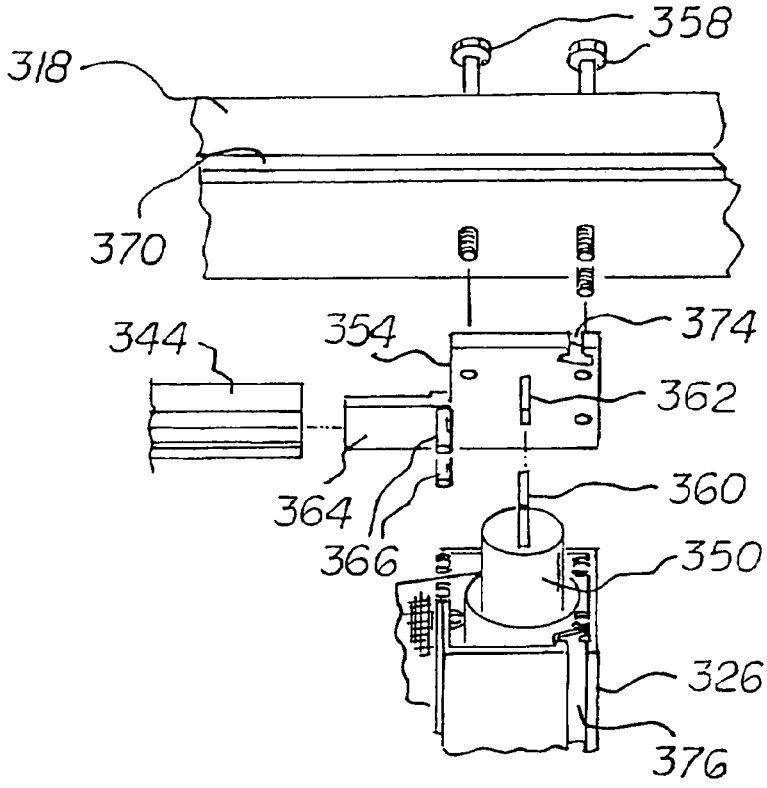
FIG. 15 is an exploded perspective illustration of the components shown in FIG. 12.
Figure 16:
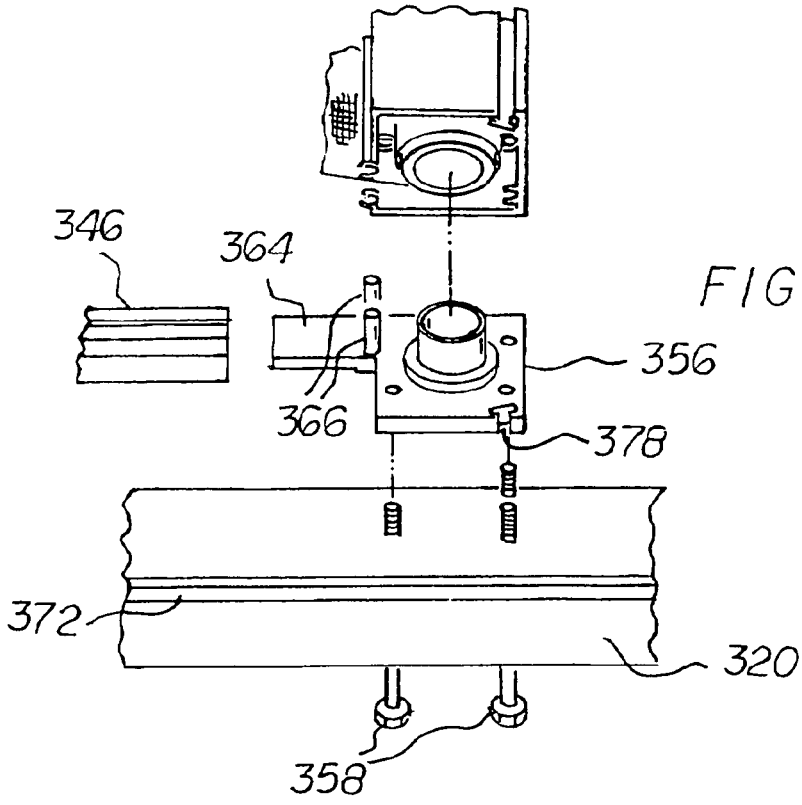
FIG. 16 is an exploded perspective illustration of the components shown in FIG. 13.
Figure 18A:
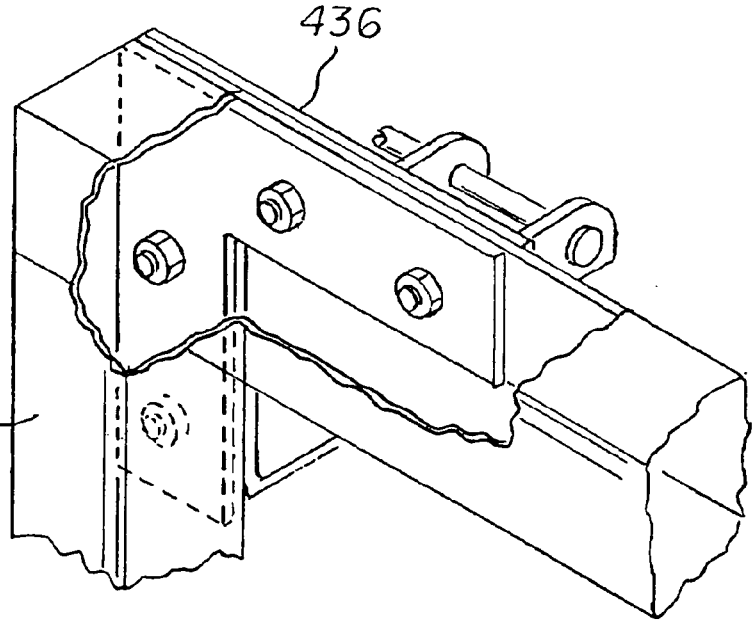
FIGS. 18A and 19A are reverse perspective views of the upper hinged bracket and lower bracket shown in FIGS. 18 and 19 illustrating the method by which they are secured to the rails of the garage door.
Figure 19A:
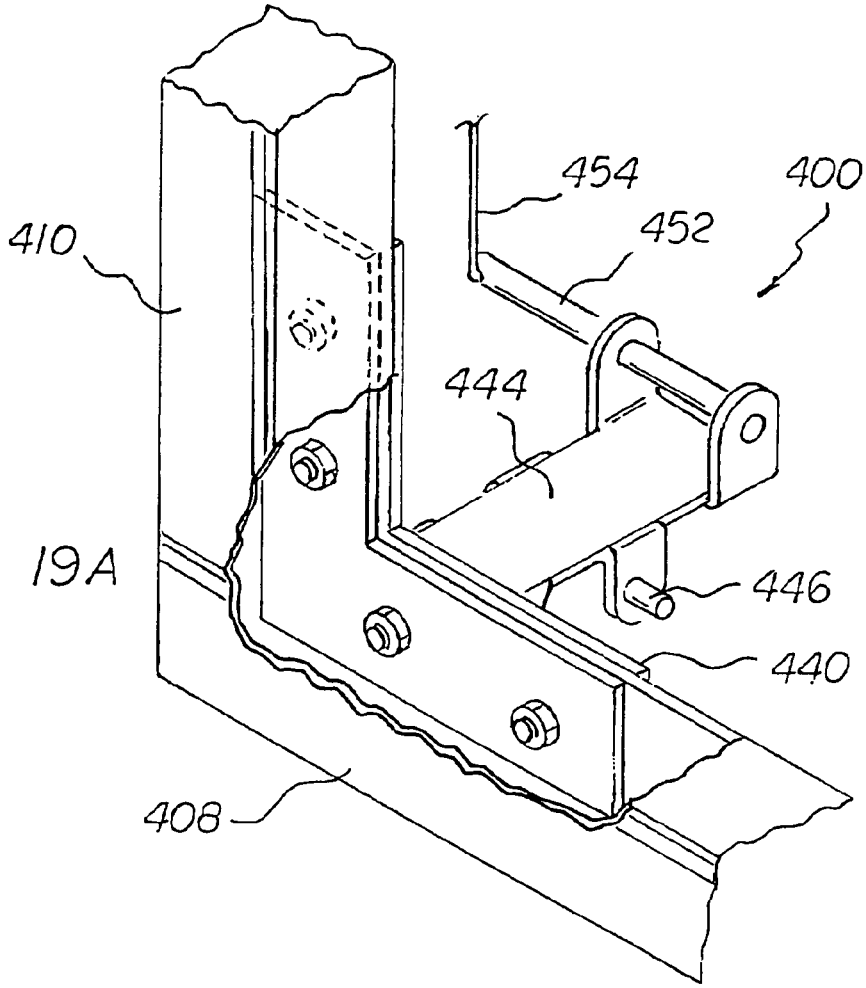

FIGS. 14, 15 and 16 illustrate the preferred embodiment of the invention with the spline grooves for the end caps and the housing post being in an angularly disposed, rectangular configuration. Alternate configurations of spine grooves for different types of splines are included in the present invention. One alternate configuration includes essentially square spline grooves 376A as shown in FIG. 14A. Another alternate configuration includes essentially circular spline grooves 376B as shown in FIG. 14B.

The preferred embodiment of the garage door/track/coupler system 400 for slidably coupling a one-piece garage door to inverted L-shaped guide tracks through wheeled coupling assemblies, is shown in FIGS. 17-29. The coupling is done in a convenient and economical manner.

First provided in the preferred embodiment is a one-piece garage door 404. The garage door has a rectangular configuration with a horizontal upper rail 406 and a parallel lower rail 408 separated by a height. The garage door has a vertical first side rail 410 and a parallel second side rail 412 separated by a width. Each of the rails is rigid. The garage door has a screen 414 secured to, and extending between, the upper and lower and side rails. The garage door has a front face and a rear face. A small screen door 416 is mounted in the garage door. The screen door constitutes between 12.5 and 25 percent of the area of the garage door. The screen door is movable with respect to the garage door between an open orientation and a closed orientation.

Next provided is a track assembly. The track assembly has a horizontal first upper track 420 and a parallel second upper track. The first and second upper tracks are separated by a width greater than the width of the garage door. The track assembly has a vertical first lower track 424 and a parallel second lower track. The first and second lower tracks are separated by a width greater than the width of the garage door.

Each of the upper track 420 and lower track 424 has a C-shaped cross-sectional configuration with a maximum height of 2 inches plus or minus 10 percent. Each track has an interiorly facing opening 474 of between 0.25 and 0.75 inches. Newly designed and manufactured arcuate intermediate tracks 428 couple one upper track 420 with one lower track 424 into an inverted L-shaped configuration. A first intermediate track 428 couples the first upper track 420 to the first lower track 424 forming the first L-shaped track assembly. A second intermediate track 430 couples the second upper track 422 to the second lower track 426 forming the second L-shaped track assembly. Each intermediate track has a radius of curvature between 1 and 2 inches. The intermediate tracks have an interiorly facing opening 432 and guides 476, 478 to maintain a continuous interior channel from the horizontal upper tracks to the vertical lower tracks. The tight radius of curvature is necessary to allow the secondary garage door to operate within the available clearances of the garage chamber. The first and second track assemblies allow the one-piece garage door to slide from horizontal open position to vertical closed position within this tight curvature.

Next provided are newly designed and manufactured upper hinged brackets 436. The first upper hinged bracket 436 is secured to the rear face of the garage door adjacent to an intersection of the upper rail and the first side rail. The second upper hinged bracket 438 is secured to the rear face of the garage door adjacent to an intersection of the upper rail and the second side rail. A perpendicular arm 444 extends interiorly from each upper hinged bracket. A hinge pin 472 is secured to each arm parallel with the upper and lower rails of the garage door and connects the perpendicular arm to a hinged wheel assembly 470. The hinged wheel assembly is made up of a flat-bottomed U-shaped arm extending from the hinge pin to an axle 446. The axle extends through the opening of the upper track. A plurality of rollers 448 is provided next. One roller 448 is secured to the axle and rotatably received within the upper tracks. The upper hinged brackets are necessary to allow the secondary garage door to operate within the available clearances of the garage chamber to keep its rollers in the upper tracks at all times and to allow the garage door to be in the desired position when open and closed.

Next provided are newly designed and manufactured lower brackets 440. The first lower bracket 440 is secured to the rear face of the garage door adjacent to an intersection of the lower rail and the first side rail. The second lower bracket 442 is secured to the rear face of the garage door adjacent to an intersection of the lower rail and the second side rail. A perpendicular arm 444 extends interiorly from each lower bracket. An axle 446 is secured to each arm parallel with the upper and lower rails of the garage door. The axle extends through he opening of the lower track. One roller 448 is secured to the axle and rotatably received within the lower tracks. The lower brackets are necessary to allow the garage door to be in the desired position when open and closed and to allow its rollers to move from the lower track to the upper track as the garage door moves from the closed to the open position and vice versa.

Lastly, a lifting rod 452 is secured to the first lower bracket 440. A cable 454 has a first end coupled to the lifting rod and a second end coupled to a spring 88. The cable has an intermediate extent trained around a pulley. The pulley has an axis of rotation passing through the first intermediate track 428. A lifting rod 452 is secured to the second lower bracket 442. A cable 454 has a first end coupled to the lifting rod and a second end coupled to a spring. The cable has an intermediate extent trained around a pulley 456 that has an axis of rotation passing through the second intermediate track. The lifting mechanism thereby formed reduces the amount of effort required to lift the garage door from the closed lower orientation to the open raised orientation. The lifting mechanism also allows the garage door to be gently lowered from the open raised orientation to the closed lower orientation.

In an alternate embodiment, each intermediate track 428A includes an upper end opening 428B and a lower end opening 428C. The upper and lower end openings are coupled to the upper and lower tracks respectively. A supplemental opening 428D is provided in each intermediate track in horizontal alignment with the upper end opening to facilitate assembly and fabrication.

An alternate embodiment of the system 400 is shown in FIG. 24. In this embodiment, the small door is two small doors 416 remote from a vertical centerline of the garage door 404.

Another alternate embodiment of the system 500 is shown in FIG. 25. In this embodiment, the small door is two small doors 504 adjacent to a vertical centerline of the garage door 506.

Another embodiment of the system 600 is shown in FIGS. 26 and 27. In this embodiment, the small door 606 has guide rollers 608 adapted to reciprocate on guide ways 610 when moving the small door between the open and closed orientation. The guide ways are coupled to the upper and lower rails 612, 614 of the garage door 604.

Yet another embodiment of the system 700 is shown in FIG. 28. In this embodiment, the garage door 704 further includes one smaller pet door 706 adjacent to the lower rail of the garage door 708.

A final embodiment of the system 800 is shown in FIG. 29. In this embodiment, the small door is one smaller pet door 804 adjacent to the lower rail of the garage door 806.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A garage door/track/coupler system comprising, in combination:

a customary garage with a conventional garage door system comprised of a primary garage door, primary garage door tracks and primary rollers attached to the primary garage door and with the primary rollers received in the primary tracks where the primary garage door operates in the conventional manner;

a one-piece secondary garage door having a rectangular configuration with rigid horizontal upper and lower rails and having rigid vertical first and second side rails forming a rigid frame border around an extent of space, the rails adapted to secure mesh to the rails thereby covering the extent of space bordered by the rails;

a secondary track assembly having horizontal first and second upper tracks, the secondary track assembly having vertical first and second lower tracks, an arcuate first intermediate track coupling the first upper track and the first lower track, an arcuate second intermediate track coupling the second upper track and the second lower track;

first and second upper brackets secured to the one-piece secondary garage door, first and second lower brackets secured to the one-piece secondary garage door, the first and second upper brackets and the first and second lower brackets adapted and located on the frame in such a manner as to maneuver the one-piece secondary garage door, when the one-piece secondary garage door is in the vertical closed orientation, interchangeably into the position that is occupied by the primary garage door when the primary garage door is in its vertical closed orientation; and a plurality of secondary rollers, each secondary roller coupled to one of the first and second upper brackets and first and second lower brackets and all of the secondary rollers rotatably received within the secondary track assembly for guiding the movement of the one-piece secondary garage door between a closed lower vertical orientation and an open raised horizontal orientation.

2. The system as set forth in claim 1 and further including, in combination:

at least one lifting rod secured to the one-piece secondary garage door, a cable coupled to each lifting rod and also coupled to a spring in such a manner as to minimize the force required to lift the one-piece secondary garage door from the closed lower orientation to the open raised orientation.

3. The system as set forth in claim 1 wherein the one piece secondary garage door is a large screened door.

4. The system as set forth in claim 1 wherein the one piece secondary garage door is a large un-screened door.

5. The system (400) as set forth in claim 1 and further including two small passage doors (416) remote from a vertical centerline of the one-piece secondary garage door (404).

6. The system (500) as set forth in claim 1 and further including two small doors (504) adjacent to a vertical centerline of the one-piece secondary garage door (506).

7. The system (600) as set forth in claim 1 and further including a small passage door having guide rollers (608) adapted to reciprocate on guide ways (610) when moving the small door between the open and closed orientation, the guide ways being coupled to the upper and lower rails (612), (614) of the one-piece secondary garage door (604).

8. The system (700) as set forth in claim 1 wherein the one-piece secondary garage door (704) further includes one smaller pet door (706) adjacent to the lower rail of the one-piece secondary garage door (708).

9. The system as set forth in claim 3 and further including a small passage door constructed as a small screen door adapted to roll into a coil when in the open orientation.

10. The system as set forth in claim 1 wherein each intermediate track (428, 428A) is arcuate with a sharp radius of curvature of between 1 and 2 inches and includes:

an upper guide bar (476, 476A) designed to channel the secondary rollers of the first and second lower bracket smoothly into and out of the vertical track around the tight radius of the intermediate track;

a lower guide bar (478, 478A) designed to stop the secondary rollers attached to the first and second upper bracket in the horizontal portion of the secondary track assembly in order to allow the one-piece secondary garage door to operate within the clearances available in the customary garage;

an upper end opening (428B) and a lower end opening (428C), the upper and lower end openings coupled to the upper and lower tracks respectively;

a continuous C-shaped passage contiguous with the upper horizontal secondary track and the lower vertical secondary tracks; and a supplemental opening (428D) in each intermediate track in horizontal alignment with the upper end opening to facilitate assembly and fabrication.

11. The system as set forth in claim 1 wherein the first and second upper brackets are upper hinged brackets with a hinge pin parallel with the upper and lower rails of the one-piece secondary garage door, the upper hinged brackets adapted to increase the distance between the secondary rollers and the one-piece secondary garage door when in the lowered vertical orientation thereby assisting the one-piece secondary garage door to form a complete closure of the garage opening and occupy the same position and footprint as the primary garage door when the primary garage door is in the vertical lowered position and also to decrease the distance between the secondary rollers and the one-piece secondary door when in the horizontal raised orientation so as to maximize the vertical space of the garage chamber available under the one-piece secondary garage door.

12. A garage door/track/coupler system (400) for slidably coupling a one-piece secondary garage door to inverted L-shaped secondary guide tracks through wheeled coupling assemblies, the system comprising, in combination:

a customary garage with a conventional garage door system comprised of a primary garage door, primary garage door tracks, and primary rollers attached to the primary garage door, the primary rollers being received in the primary tracks where the primary garage door operates in the conventional manner;

a one-piece secondary garage door (404), the one-piece secondary garage door having a rectangular configuration with a horizontal upper rail (406) and a parallel lower rail (408) separated by a height, the one-piece secondary garage door having a vertical first side rail (410) and a parallel second side rail (412) separated by a width, each of the rails being rigid, the one-piece secondary garage door having a screen (414) secured to, and extending between, the upper and lower and side rails, the one-piece secondary garage door having a front face and a rear face;

a secondary track assembly having a horizontal first upper track (420) and a parallel second upper track (422) separated by a width greater than the width of the one-piece secondary garage door, the secondary track assembly having a vertical first lower track (424) and a parallel second lower track (426) separated by a width greater than the width of the one-piece secondary garage door, each vertical track having a length less than the height of the one-piece secondary garage door, a first arcuate intermediate track (428) coupling the first upper track and the first lower track into an inverted L-shaped configuration, a second intermediate track (430) coupling the second upper track and the second lower track into an inverted L-shaped configuration, each arcuate intermediate track having the same radius of curvature, such radius of curvature being between 1 and 2 inches, each of the tracks having a C-shaped cross-sectional configuration, each of the tracks having an interiorly facing opening;

a first upper hinged bracket (436) secured to the rear face of the one-piece secondary garage door adjacent to an intersection of the upper rail and the first side rail, a second upper hinged bracket (438) secured to the rear face of the one-piece secondary garage door adjacent to an intersection of the upper rail and the second side rail, a first lower bracket (440) secured to the rear face of the one-piece secondary garage door adjacent to an intersection of the lower rail and the first side rail, a second lower bracket (442) secured to the rear face of the one-piece secondary garage door adjacent to an intersection of the lower rail and the second side rail, a perpendicular arm (444) extending interiorly from each bracket, an axle (446) secured to each arm parallel with the upper and lower rails of the one-piece secondary garage door, each axle extending through an opening of one of the tracks, rollers (448), each of the rollers secured to one of the axles and rotatably received within one of the tracks for guiding the movement of the one-piece secondary garage door between a closed lower orientation and an open raised orientation; and a lifting rod (452) secured with a cable (454) to the first lower bracket, the cable having an intermediate extent trained around a pulley (456), the cable having a first end coupled to the lifting rod and a second end coupled to a spring to minimize the force required to lift the one-piece secondary garage door from the closed lower orientation to the open raised orientation, the pulley having an axis of rotation passing through the first intermediate track.

13. The system set forth in claim 1 and further including, in combination, a small passage door contained within the extent of space bordered by the rails of the one-piece secondary garage door.

14. The system as set forth in claim 13 wherein the passage door is made up of two small doors.

15. The system (800) as set forth in claim 13 and further including a smaller pet door (804) adjacent to the lower rail of the one-piece secondary garage door (806).

* * * * *